US010759576B2

(12) United States Patent
Port et al.

(10) Patent No.: US 10,759,576 B2
(45) Date of Patent: Sep. 1, 2020

(54) CLOSURE INTERLOCKING MECHANISM THAT PREVENTS ACCIDENTAL INITIAL OPENING OF A CONTAINER

(71) Applicant: The Procter & Gamble Company, Cincinnati, OH (US)

(72) Inventors: Markus Port, Steinbach (DE); Ibrahim Ulas, Steinbach (DE); Marion Michele Marie-Pierre Dubreuil, Braine L'Alleud (BE)

(73) Assignee: The Procter and Gamble Company, Cincinnati, OH (US)

( * ) Notice: Subject to any disclaimer, the term of this patent is extended or adjusted under 35 U.S.C. 154(b) by 113 days.

(21) Appl. No.: 15/718,616

(22) Filed: Sep. 28, 2017

(65) Prior Publication Data

US 2018/0127179 A1 May 10, 2018

Related U.S. Application Data

(60) Provisional application No. 62/400,917, filed on Sep. 28, 2016.

(51) Int. Cl.
*B65D 55/02* (2006.01)
*B65D 47/08* (2006.01)

(52) U.S. Cl.
CPC ..... *B65D 55/024* (2013.01); *B65D 47/08* (2013.01); *B65D 47/0885* (2013.01); *B65D 2251/1025* (2013.01)

(58) Field of Classification Search
CPC ..... B65D 55/06; B65D 55/16; B65D 51/18; B65D 51/24; B65D 47/0857; B65D 43/169; B65D 43/13; B65D 2101/00
(Continued)

(56) References Cited

U.S. PATENT DOCUMENTS 2,138,560 A 11/1938 Kimberly
D154,552 S 7/1949 Lauby
(Continued)

FOREIGN PATENT DOCUMENTS

AU 645214 2/1993
BQ BX25863-012 9/1995
(Continued)

OTHER PUBLICATIONS

U.S. Appl. No. 15/718,645, filed Sep. 28, 2017, Markus Port.
(Continued)

*Primary Examiner* — Chun Hoi Cheung
*Assistant Examiner* — Brijesh V. Patel
(74) *Attorney, Agent, or Firm* — Linda M. Sivik

(57) ABSTRACT

The present invention is directed toward a container closure that prevents accidental initial opening of a container. The closure mechanism includes at least one temporary interlocking mechanism having a two part fastener that engages the moveable part of the closure with the fixed part of the closure. The temporary interlocking mechanism is invisible when the container is closed. It is positioned in a location different from the location of the orifice of the closure or from the path that the liquid follows during dispensing. This temporary interlocking mechanism includes at least one element that breaks or irreversibly deforms during the initial opening of the container. The additional force required to break or to irreversibly deform the breakable or irreversibly deformable element of the temporary interlocking mechanism during the first opening mitigates the risk of accidental opening during manufacturing, shipment or storage of the goods. Once broken or irreversibly deformed during the first opening, the interlocking mechanism does not interfere with the subsequent opening and closing cycles of the container by the consumer.

11 Claims, 2 Drawing Sheets

(58) Field of Classification Search
USPC .... 220/114, 254.3, 254.1, 254.9, 259.1, 212, 220/265, 266; 215/243, 237, 235, 228, 215/250, 254, 253; 222/568, 567, 562, 222/559
See application file for complete search history.

(56) References Cited

U.S. PATENT DOCUMENTS

D158,396 S 5/1950 Lisbon
2,571,833 A 10/1951 Chidsey, Jr.
2,889,087 A 6/1959 Paull
3,045,860 A 7/1962 Edwige
3,237,571 A 3/1966 Corsette
3,331,500 A 7/1967 Jules
3,341,005 A 9/1967 Jules
3,362,344 A 1/1968 Duda
D219,643 S 1/1971 Garbus
3,583,605 A 6/1971 Corsette
3,591,298 A 7/1971 Green
3,968,914 A 7/1976 Goncalves
4,172,540 A 10/1979 Erichson
4,244,495 A * 1/1981 Lorscheid ..... B65D 47/0819 222/153.14
4,344,545 A 8/1982 Aschberger
4,357,905 A 11/1982 Carpenter
4,359,166 A 11/1982 Dubach
4,369,899 A 1/1983 Magers
4,371,088 A 2/1983 Gach
4,371,099 A 2/1983 Foster
4,431,110 A 2/1984 Roth
4,462,504 A 7/1984 Roth
4,545,495 A 10/1985 Kinsley
4,609,114 A 9/1986 Roy
4,610,371 A * 9/1986 Karkiewicz ..... B65D 47/0838 206/807
4,625,898 A 12/1986 Hazard
4,640,427 A 2/1987 Marino et al.
4,658,955 A * 4/1987 Eichner ..... G11B 33/0411 206/1.5
4,666,068 A 5/1987 Bush
4,711,372 A * 12/1987 Gach ..... B65D 47/0885 206/807
4,718,567 A * 1/1988 La Vange ..... B65D 50/06 215/206
4,749,108 A 6/1988 Dornsbusch
4,852,770 A * 8/1989 Sledge ..... B65D 47/0814 222/153.14
D306,220 S 2/1990 Wang
D310,027 S 8/1990 Bixler
4,948,002 A 8/1990 Thornock
D311,487 S 10/1990 Platt
4,991,746 A 2/1991 Schultz
5,108,029 A 4/1992 Abrams
5,180,088 A 1/1993 De Angeli
5,191,975 A 3/1993 Pezzoli
D342,023 S 12/1993 Bonkowski
5,356,017 A * 10/1994 Rohr ..... B65D 47/0838 215/216
D353,232 S 12/1994 Chrisco
5,524,793 A 6/1996 Oneill
5,570,818 A 11/1996 Strong
5,685,444 A * 11/1997 Valley ..... B65D 47/0838 215/237
5,715,973 A 2/1998 Foster
5,738,250 A 4/1998 Gillingham
5,829,641 A 11/1998 Bartsch
5,853,093 A 12/1998 Neiger
6,039,181 A 3/2000 Whiteside
6,216,905 B1 4/2001 Mogard et al.
6,230,942 B1 5/2001 Kuo
6,283,332 B1 9/2001 Ragno
6,357,629 B1 3/2002 Ding
6,364,167 B1 4/2002 Safian
6,604,656 B1 8/2003 Tseng
D502,406 S 3/2005 Eddings
6,866,164 B2 * 3/2005 Branson ..... B65D 47/0814 222/153.14
D504,197 S 4/2005 Huthmaker
7,163,127 B2 * 1/2007 Seelhofer ..... B65D 47/0804 222/83
7,204,383 B2 4/2007 Hsu
H002203 H 10/2007 Burchardt et al.
D576,036 S * 9/2008 Dell'Accio ..... B65D 51/002 D9/449
7,611,024 B2 * 11/2009 Yamanaka ..... B65D 47/0814 215/237
7,658,295 B2 2/2010 Hoepner
D618,861 S 6/2010 Bahnean
7,798,348 B2 * 9/2010 Sawyer ..... B65D 50/046 215/237
7,854,351 B2 12/2010 Bougamont
8,297,438 B2 10/2012 Crossman
8,403,181 B2 3/2013 Ding
8,651,305 B1 * 2/2014 Lunn ..... B65D 51/002 215/228
8,857,638 B2 10/2014 Brozell
D717,006 S 11/2014 Alfonso
8,910,817 B2 * 12/2014 Kanderka ..... B65D 75/12 220/266
D722,891 S 2/2015 Borg
D744,819 S 12/2015 Dalisay
9,908,132 B2 3/2018 Dalisay
10,099,823 B2 10/2018 Kawamura
10,640,270 B2 5/2020 Port
2001/0050264 A1 * 12/2001 Schorner ..... B65D 47/0828 215/237
2003/0062369 A1 4/2003 Hierzer
2005/0045641 A1 3/2005 Doran
2005/0139500 A1 6/2005 Smithers
2005/0279746 A1 12/2005 Hsu
2006/0011573 A1 1/2006 Herald
2006/0201905 A1 9/2006 Perrin et al.
2008/0264961 A1 10/2008 Sawyer
2009/0101662 A1 4/2009 Marco
2009/0195401 A1 8/2009 Maroney
2010/0243511 A1 9/2010 Nicholls
2010/0308055 A1 * 12/2010 Sams ..... A61M 5/3205 220/324
2011/0137272 A1 6/2011 Adams
2011/0297700 A1 12/2011 Santagiuliana
2012/0138561 A1 6/2012 Brozell
2012/0181272 A1 7/2012 Desoto-Burt
2014/0311943 A1 10/2014 Snyder
2015/0175324 A1 6/2015 Tada
2015/0315532 A1 * 11/2015 Bergbohm ..... B65D 43/16 220/315
2016/0167840 A1 6/2016 Kleppsch
2016/0172742 A1 6/2016 Forster
2017/0057703 A1 * 3/2017 Anderson ..... B65D 27/28
2017/0203889 A1 * 7/2017 Butter-Jentsch ..... B65D 43/169
2018/0086521 A1 3/2018 Port
2018/0127179 A1 5/2018 Port
2019/0152682 A1 5/2019 Agerton
2019/0152684 A1 5/2019 Bartolucci

FOREIGN PATENT DOCUMENTS

BQ BX27419-001 1/1997
CN 3670544 7/2007
DE 2911988 A1 10/1980
EP 0381516 A2 2/1990
EP 1512634 A1 3/2005
EP 1122183 B1 4/2005
FR 2702739 B1 6/1995
FR 2743054 B1 7/1997
GB 468762 A 7/1937
GB 3001453 3/2002
GB 2512620 A 10/2014
JP D1061476 2/2000
JP 5282241 B2 9/2013

(56) References Cited

FOREIGN PATENT DOCUMENTS

| | | |
|---|---|---|
| WO | WO9524345 A1 | 9/1995 |
| WO | WO0134471 A1 | 5/2001 |

OTHER PUBLICATIONS

All final and non-final office actions for U.S. Appl. No. 15/718,645.
PCT International Search Report and Written Opinion for PCT/US2017/053873 dated Dec. 6, 2017.
AcaiBerry.com eco bottle packaging, google publish date Dec. 8, 2010, online, http://www.acaiberry.com/company.html, [site visitied Jun. 29, 2015 2:39:05 PM].
All final and non-final office actions for U.S. Appl. No. 14/689,569.
All final and non-final office actions for U.S. Appl. No. 16/194,503.
All final and non-final office actions for U.S. Appl. No. 16/194,510.
All final and non-final office actions for U.S. Appl. No. 29/471,542.
Berns, Applied Ergonomics, 1981, Ann Arbor Science Publishers Inc., Chap. 12.3, pp. 153-161.
Can Carrier—Dylan Macnab Portfolio, upload May 2013, online, http://cargocollective.com/dylanmacnab/Can-Carrier, [site visited Jun. 29, 2015 6:25:33 PM].
European Search Report for EP17203314.4 dated Nov. 4, 2018.
Howies Hockey Water Bottle Carrier, website copyright 2013, line, http://howieshockeytape.com/store/hockey-team-water-bottles/Hockey-Water-Bottle-Carriers, [site visited Jun. 29, 2015 6:35:14 PM].
PCT International Search Report and Written Opinion for PCT/US2016/027779 dated Jul. 25, 2016.
PCT International Search Report and Written Opinion for PCT/US2018/058655 dated Feb. 18, 2019.
PCT International Search Report and Written Opinion for PCT/US2018/058656 dated Feb. 18, 2019.
European Search Report for EP17203313.6 dated Dec. 4, 2018.
U.S. Appl. No. 16/194,503, filed Nov. 19, 2018, Agerton et al.
U.S. Appl. No. 16/194,510, filed Nov. 19, 2018, Agerton et al.

* cited by examiner

CLOSURE INTERLOCKING MECHANISM THAT PREVENTS ACCIDENTAL INITIAL OPENING OF A CONTAINER

FIELD OF THE INVENTION

The present invention relates to a container closure that prevents accidental initial opening of a container. The closure mechanism includes at least one temporary interlocking mechanism having a two part fastener that engages the moveable part of the closure with the fixed part of the closure. This temporary interlocking mechanism includes at least one element that breaks or irreversibly deforms during the initial opening of the container. The temporary interlocking mechanism is invisible when the container is closed. It is positioned in a location different from the location of the orifice (4) of the closure or from the path that the liquid follows during dispensing. The additional force required to break or to irreversibly deform the breakable or irreversibly deformable element of the temporary interlocking mechanism during the first opening mitigates the risk of accidental opening during manufacturing, shipment or storage of the goods. Once broken or irreversibly deformed during the first opening, the interlocking mechanism does not interfere with the subsequent opening and closing cycles of the container by the consumer.

BACKGROUND OF THE INVENTION

Liquid fast moving consumer goods like shampoo, body wash, dish detergent or laundry detergent are usually sold in rigid plastic containers. These containers are produced in mass scale and usually follow a simple technology approach and design for economic reasons. The pack material is usually produced at a step prior to the filling of the container. The final sellable unit needs to be securely closed to ensure safe shipment without any leakage of the contained liquid. In most cases, the orifice used for filling at the manufacturing site is identical to, or at least close to, the orifice designed for the usage phase at the consumer's home. This does not apply to tubes, which are permanently sealed after the filling process while the intended consumer dispensing orifice is located at the opposite end to the filling position. Most standard bottled liquids in plastic containers are closed by a plastic cap, also referred to as a closure or a closure assembly. Typically, the cap is attached to the container after the filling of the bottle at the manufacturer and is either screwed on, snapped on or sealed on. All caps snapped or sealed onto the bottle usually come with a moveable feature. Examples of caps that have a moveable feature are flip top or disc top closures. These caps allow consumers to open the bottle and dispense the product in a controlled way, while the caps main part remains attached to the bottle.

The closure needs to be designed in such a way so that, during the use of the product, it can be readily opened and closed by the consumer without requiring excessive force. However, closures that can be readily opened using weak forces are occasionally accidentally and undesirably opened during product manufacturing, transportation and storage. Thus, there is a need for closures that require (1) increased amount of force for the initial opening and (2) relatively low force for opening and closuring of the container after its initial opening and during the regular use by the consumer. In other words, the closure needs to provide tightness under manufacturing, transportation and storage conditions, while it allows the consumer of the product to readily open the container, dispense part of its content and close the container when needed. Part of the performance of the closure can be defined by these two fundamentally different requirements, that is, being tight before the initial opening and easy to open afterwards.

The present invention described herein has found a solution to this tension by introducing means of a sturdy connection between the moveable and the fixed part of a closure, hence increasing the tightness performance of the system. The initial opening of the closure system of the current invention requires a higher force than regular systems, while subsequent openings require reduced opening and closure force. The invention utilizes means of a breakably or deformably connecting the moveable part of the closure with its fixed base (1). This connection is achieved by a two part mechanical fastener, such as a hook (5) and loop (6) fastener, having an element that requires a defined force to be broken or being deformed. The container of the invention does not intend to communicate to the consumer the location of the connection. Thus, the breaking point is located in an area that is not eminent to the user under normal storage and use.

SUMMARY OF THE INVENTION

In an embodiment of the present invention, a closure for a liquid container comprising at least one temporary interlocking mechanism not visible during the closed state of the container: wherein the temporary interlocking mechanism, has a two part fastener that engages the moveable part of the closure with the fixed part of the closure, and wherein the temporary interlocking mechanism includes at least one element that breaks or irreversibly deforms during the initial opening of the container the breaking of the deformation requiring a force with magnitude higher than a threshold force, and further wherein the temporary interlocking mechanism is positioned in a location different from the location of an orifice of the closure or from the path that the liquid content of the container follows during dispensing, and further wherein the temporary interlocking mechanism, after breaking or irreversibly deforming during the initial opening of the container, does not interfere with the opening and closing of the container during its regular use by the user, and wherein the ratio of the threshold force value to the required force to open the closure after the initial opening is larger than 1.25 N. The present invention fulfills the need described above by providing container closure structures that include at least one temporary interlocking mechanism having a two part fastener that engages the moveable part and the fixed part of the closure. The fastener has a breakable or irreversibly deformable element. The temporary interlocking mechanism is invisible when the container is closed and is positioned in a location that is different from the location of the orifice (4) of the closure or from the path that the liquid follows during dispensing.

DETAILED DESCRIPTION OF EMBODIMENTS OF THE INVENTION

Figure 1:
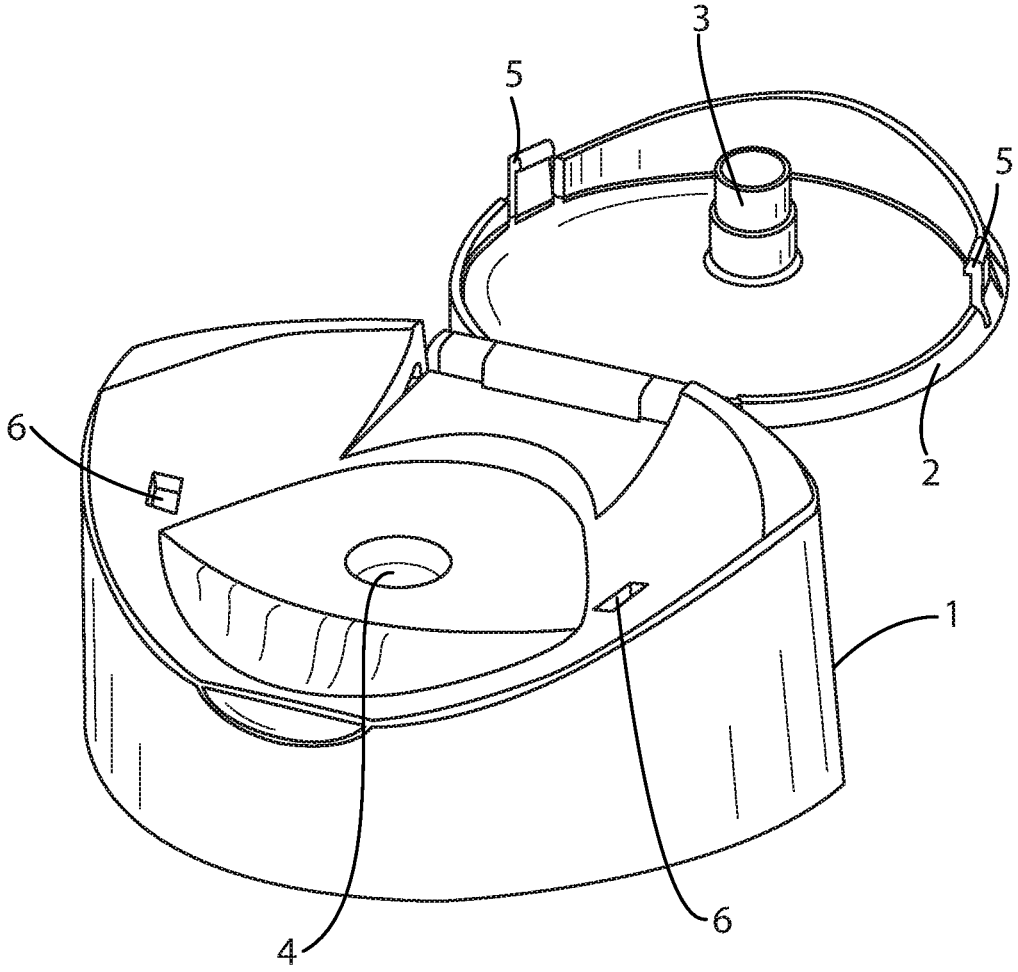
FIG. 1 is a flip top (2) type cap with a hook (5) and loop (6) technology. The moveable flip top (2) itself is connected to the base (1) of the cap via the hinge. Left and right of the flip top (2) the hooks (5) are visible which engage in the closed stage with the loops (6) left and right of the base (1) of the cap.
Figure 2:
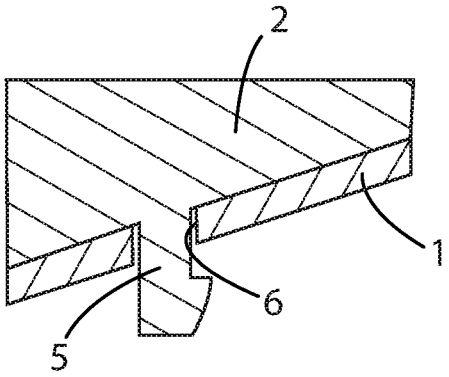
FIG. 2 is an enlarged view of a hook (5), moveable flip top (2) itself connected to the base (1) of the cap, wherein hook (5) once engaged with the loop (6), can be released by increasing the force, resulting with either a breakage or wear out of the hook (5).
Figure 2A:
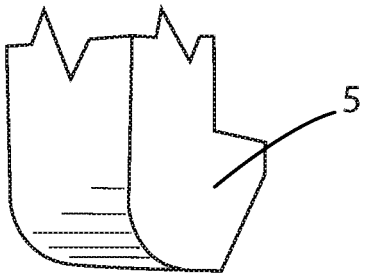
FIG. 2A is an enlarged view of a hook (5).

All percentages and ratios used herein are by weight of the total composition, unless otherwise designated. All measurements are understood to be made at ambient conditions, where "ambient conditions" means conditions at about 25° C., under about one atmosphere of pressure, and at about 50% relative humidity, unless otherwise designated. All numeric ranges are inclusive of narrower ranges; delineated upper and lower range limits are combinable to create further ranges not explicitly delineated.

A typical container for consumer goods includes either a flip top closure or a disc top closure. A non-limiting example is a flip top (2) closure, which has a pin (3), as an integral part of the moveable flip top (2) lid, and an opening or orifice (4) on the fixed base (1) of the closure. Such closure mechanism will tighten the system, both in transit as well as in use. Alternatively, in the non-limiting example of a disc top closure, the moveable part can be a disc that is integrated into the body of the closure and rotates around an axis. This rotation of the moving part of the closure creates a channel connecting the contents of the container with the outside of the container so that the contents can be dispensed by the consumer. A typical method of making flip top (2) and disc top closures includes injection molding of different plastics like polyethylene (PE), polypropylene (PP) or polyethylene terephthalate (PET).

Containers having closures with moveable parts can be readily opened and closed by the consumer during the product use. That is, the containers do not require excessive force for the routine opening and closing operation. However, the same container can be transported and stored safely without accidental opening and leaking of the liquid, before it reaches the consumer. Indeed, a problem that is occasionally encountered in containers that include closures having moving parts, such as flip top (2) and disk top closures, is the accidental opening of the container and product leakage during manufacturing, transportation and storage. The present invention has found that container closures can be designed and produced so that they are safely transported and stored with very low probability of accidental opening. Then, they can be readily opened and closed by the consumer during the regular use of the product by the consumer. This is achieved by using closures wherein the force required to open the container for the first time is significantly higher than the force required to open the container after the initial opening. More specifically, these closures use a mechanism that prevents the accidental initial opening of a container. The mechanism includes at least one temporary interlocking mechanism having a two part fastener that engages the moveable part of the closure with the fixed part of the closure. This temporary interlocking mechanism includes at least one element that breaks or irreversibly deforms during the initial opening of the container. The temporary interlocking mechanism is invisible when the container is closed. The temporary interlocking mechanism is positioned in a location that is different from the location of the orifice (4) of the closure or from the path that the liquid follows during dispensing. The additional force required to break or to irreversibly deform the element of the temporary interlocking mechanism and to open the container during the first opening significantly reduces the risk of accidental opening during shipment or storage of the goods. The temporary interlocking mechanism is achieved by using a two part mechanical fastener, such as a hook (5) and loop (6) fastener, that connects the moveable to the fixed part of the closure, wherein the two part mechanical fastener inhibits the separation between the parts applying a force below a specific threshold, and wherein the two part mechanical fastener breaks or it is irreversibly deformed during the first opening of the container when a force above the threshold is applied.

Intentional opening by consumers is possible by overcoming the initial opening force and breaking the mechanical connection. This event is intentionally not clearly apparent to consumers and does not require any additional action by the consumers. Any subsequent opening of the moveable part will require the regular, lower force as intended.

One embodiment of the present invention includes a container having a flip top (2) closure wherein the closure also includes an interlocking mechanism having a two part fastener that contains an element that breaks during the initial opening of the closure if a force is applied that is higher than a threshold value. A non-limited example of the two part fastener is a hook (5) and loop (6) type. The hook (5) is interlocked with the loop (6) when closure is at the closed state and the closure has never been opened. The hook (5) and loop (6) fastener is in a different location from the orifice (4) of the closure. The hook (5) element is part of the moveable part of the closure and the loop (6) is part of the fixed part of the closure. The hook (5) and loop (6) fastener consists of complementary parts which engage to form a firm joint. However, as opposed to some typical use of such interlocking mechanism, the fastener in this embodiment is not re-engageable, because the hook (5) does not have sufficient flexibility. Thus, when the closure is opened, using a sufficient force, it breaks and it cannot be interlocked with the loop (6) thereafter. Any hook (5) and loop (6) fastener familiar to the person having ordinary skill in the art may be used to achieve the desired interlocking mechanism. That is, the hook (5) and loop (6) fastener can have different hook (5) shapes, such as anchor-shaped, barbed shaped, mushroom shaped and others. Analogously, the loop (6) part of the fastener can be of different shapes and designs. Other two part fasteners familiar to a person having ordinary skill in art that can be used such as stud-type fasteners, nut and bolt fasteners, and others. The force required to break or irreversibly deform the interlocking mechanism depends on the material hardness, flex modulus, rigidity as well as the geometry and 3D design.

In an embodiment of the present invention, the ratio of the threshold force value to the required force to open the closure after the initial opening is larger than 1.25. In a further embodiment, wherein the ratio of the threshold force value to the required force to open the closure after the initial opening is larger than 1.5. In yet a further embodiment, the ratio of the threshold force value to the required force to open the closure after the initial opening is larger than 2. In a further embodiment, the ratio of the threshold force value to the required force to open the closure after the initial opening is larger than 3. In a further embodiment, the ratio of the threshold force value to the required force to open the closure after the initial opening is larger than 4. In a further embodiment, the ratio of the threshold force value to the required force to open the closure after the initial opening is larger than 5. In an embodiment, the threshold force required to open the closure for the first time is from about 12 N to about 50 N. In a further embodiment, the threshold force required to open the closure for the first time is from about 18 N to about 40 N. In yet a further embodiment, the threshold force required to open the closure for the first time is from about 20 N to about 35 N.

The flip top (2) closure also includes at least one permanent interlocking mechanism between the moveable part of the closure with its fixed base (1). A non-limited example of a permanent interlocking mechanism is a pin (3) and hole. The permanent engagement allows for multiple openings and closings during the life of the container for dispensing of the product. In the case of the pin (3) and hole, the permanent force required to open the closure after the initial opening depends on the material properties of the chosen plastic, mainly friction, and the three dimensional shape. The closure is required to comprise of an orifice (4) that is air tight in the closed state so that evaporation and contamination is prevented. Additional friction between the closure parts will increase the opening force requirement as designed per actual technical and consumer requirements. The flip top (2) closure that includes both interlocking mechanisms, the temporary and the permanent interlocking mechanisms, can be manufactured by injection molding.

Another embodiment of the present invention includes a container having a flip top (2) closure wherein the closure also includes an interlocking mechanism having a two part fastener that contains an element that irreversibly deforms, instead of breaking, during the initial opening of the closure if a force is applied that is higher than a threshold value, as described above. The deformation occurring during the first opening of the closure of the container results in the inability of the elements of the fastener to reengage in an interlocking manner. More specifically, the hook (5) or the loop (6) is designed in such a way that it is deformed during the initial opening and cannot achieve its original shape. This defined functionality may be achieved by the selection of proper plastic material, material thickness and molding process conditions.

Another embodiment of the present invention includes a container having a flip top (2) closure wherein the closure also includes two interlocking mechanisms each having a two part fastener that contains an element that breaks or irreversibly deforms during the initial opening of the closure if a force is applied that is higher than a threshold value, as described above.

Intentional opening by consumers is possible by overcoming the initial opening force and breaking the mechanical connection. This event is intentionally not clearly apparent to consumers and does not require any additional action by the consumers. Any subsequent opening of the moveable part will require the regular, lower force as intended.

In an embodiment of the present invention, non-limiting examples materials with appropriate physical properties to be used for closures described herein manufactured via injection molding are polypropylene (PP), High Density Polyethylene (HDPE), polyethylene Terehthalate (PET), Polyvinyl chloride (PVC) and others.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed:

1. A closure for a liquid container comprising at least one temporary interlocking mechanism not visible during the closed state of the liquid container:

a) wherein at least one temporary interlocking mechanism, has a two part fastener that engages a moveable part of the closure with a fixed part of the closure wherein the two part fastener is a hook and loop fastener, and (b) wherein at least one temporary interlocking mechanism includes at least one element that irreversibly deforms during the initial opening of the liquid container wherein the deformation requires a force with a magnitude higher than a threshold force, and (c) further wherein at least one temporary interlocking mechanism is positioned in a location different from the location of an orifice of the closure or from a path that a liquid content of the liquid container follows during dispensing, (d) and further wherein at least one temporary interlocking mechanism, after irreversibly deforming during the initial opening of the liquid container, does not interfere with the opening and closing of the liquid container during subsequent use, and (e) wherein a ratio of the threshold force value to a required force to open the closure after the initial opening is larger than 1.25.

2. The closure according to claim 1, wherein the ratio of the threshold force value to the required force to open the closure after the initial opening is larger than 1.5.

3. The closure according to claim 1, wherein the ratio of the threshold force value to the required force to open the closure after the initial opening is larger than 2.

4. The closure according to claim 1, wherein the ratio of the threshold force value to the required force to open the closure after the initial opening is larger than 3.

5. The closure according to claim 1, wherein the ratio of the threshold force value to the required force to open the closure after the initial opening is larger than 4.

6. The closure according to claim 1, wherein the ratio of the threshold force value to the required force to open the closure after the initial opening is larger than 5.

7. The closure according to claim 1, wherein the threshold force required to open the closure for the first time is from 12 N to about 50 N.

8. The closure according to claim 1, wherein the threshold force required to open the closure for the first time is from 18 N to about 40 N.

9. The closure according to claim 1, wherein the threshold force required to open the closure for the first time is from 20 N to about 35 N.

10. The closure according to claim 1, wherein the closure is a flip top closure.

11. The closure according to claim 1, wherein the closure which comprises at least one temporary interlocking mechanism further comprises two temporary interlocking mechanisms both of which contain a hook and loop fastener.

* * * * *